United States Patent [19]

Olsen

[11] Patent Number: 4,755,814

[45] Date of Patent: Jul. 5, 1988

[54] ATTRIBUTE CONTROL METHOD AND APPARATUS

[75] Inventor: Richard Olsen, Littleton, Mass.

[73] Assignee: Prime Computer, Inc., Natick, Mass.

[21] Appl. No.: 831,714

[22] Filed: Feb. 21, 1986

[51] Int. Cl.[4] ..... G09G 1/16

[52] U.S. Cl. ..... 340/799; 340/732; 340/750

[58] Field of Search ..... 340/723, 732, 747, 726, 340/728, 750, 798, 792, 799

[56] References Cited

U.S. PATENT DOCUMENTS

| | | | |
|---|---|---|---|
| 4,249,172 | 2/1981 | Watkins et al. | 340/799 |
| 4,386,410 | 5/1983 | Pandya et al. | 340/726 |
| 4,394,650 | 7/1983 | Long et al. | 340/747 |
| 4,414,645 | 11/1983 | Ryan et al. | 340/750 |
| 4,451,824 | 5/1984 | Thayer et al. | 340/732 |
| 4,454,593 | 6/1984 | Fleming et al. | 340/723 |
| 4,520,356 | 5/1985 | O'Keefe et al. | 340/750 |

*Primary Examiner*—Gerald L. Brigance
*Assistant Examiner*—Mahmoud Fatahiyar
*Attorney, Agent, or Firm*—Wolf, Greenfield & Sacks

[57] ABSTRACT

An apparatus for controlling visual attributes associated with characters displayed on a video display screen including a video memory for storing multiple data words corresponding to screen character locations, an attribute memory associated with the video memory for storing visual attribute codes and an attribute propagation store associated with the attribute memory for controlling visual attribute code propagation. A latch controls writing into the attribute propagation memory, a control bit for controlling visual attribute code propagation. The apparatus also includes a video display generator and control logic responsive to the control bit for causing a predetermined attribute code to be propagated for a preselected number of screen character locations.

24 Claims, 3 Drawing Sheets

*Fig. 3*

| POSITION | ATTRIBUTE CODE 8 BITS | | | | | | | | NINTH BIT | |
|---|---|---|---|---|---|---|---|---|---|---|
| A | 1 | 0 | 0 | 0 | 0 | 0 | 0 | 0 | 1 | LATCH |
| B | 0 | 0 | 1 | 0 | 0 | 0 | 0 | 0 | 1 | LATCH |
| C | 0 | 0 | 0 | 0 | 1 | 0 | 0 | 0 | 1 | LATCH |
| D | 0 | 0 | 0 | 0 | 1 | 0 | 0 | 0 | 0 | PROPOGATE |
| E | 0 | 0 | 0 | 0 | 1 | 0 | 0 | 0 | 0 | PROPOGATE |
| ⋮ | | | | | ⋮ | | | | 0 | |
| ⋮ | | | | | ⋮ | | | | 0 | |
| ⋮ | | | | | ⋮ | | | | 0 | |
| K | 0 | 0 | 0 | 0 | 0 | 0 | 1 | 0 | 1 | LATCH |
| L | | | | | ⋮ | | | | | |

ATTRIBUTE CONTROL METHOD AND APPARATUS

BACKGROUND OF THE INVENTION

The present invention relates in general to a graphic and alpha-numeric display used in association with a computer system. More particularly, the invention relates to an improved method and apparatus for handling visual attributes.

In a video display system, visual attributes, such as blink, reverse video or underlining, are generally controlled by two different techniques. In one case, there is provided a visual attribute memory separate but commonly addressed with the screen memory. In another case the video display relies upon embedded attributes. The use of a separate visual attribute memory has the advantage of greater flexibility but requires substantial data alteration when visual attributes are to be modified.

One disadvantage associated with the use of embedded attributes is the loss of characters (column spaces) when embedded attributes are used in conjunction with non-displayable codes. By way of illustration, if one uses a non-displayable code, as sensed by appropriate logic, at say column 10 on the screen to change the screen's intensity level for columns 11–80 (for an 80 character line) then this makes column 10 essentially unavailable.

The advantage to embedded attributes is that a single code such as in the aforementioned column 10 position, can be used to control all subsequent characters.

Some embedded attribute schemes allow for more character positions on a line than can actually be displayed. For example, a line may allow for 96 character positions, but only display 80. In this case, 16 visual attribute changes are allowed per character line. This thus restricts the number of visual attribute changes allowed per line. The present invention allows as many attribute changes per line as there are characters per line.

Accordingly, it is an object of the present invention to provide an improved visual attribute control system that essentially simulates embedded attributes but without losing displayable character positions on the screen.

Another object of the present invention is to provide an improved visual attribute control system having a separate visual attribute memory permitting in one mode of operation assignment of specific visual attributes on a character-by-character basis, and in a second mode of operation enabling propagation of a visual attribute so as to simulate an embedded attribute system.

SUMMARY OF THE INVENTION

To accomplish the foregoing and other objects, features and advantages of the invention, there is provided, in a computer system having a video display screen, apparatus for controlling visual attributes associated with characters or the like that are displayed on the screen. The apparatus of the invention comprises a video memory means for storing multiple data words corresponding to screen character locations along with an attribute memory means associated with the video memory means for storing multiple visual attribute codes each of n attribute bits and corresponding to a data word and also to a screen character location. The video memory means and attribute memory means are preferably of equal memory capacity whereby attribute codes may be assigned on a character-by-character basis. Attribute propagation memory means is associated with the attribute memory means for storing at least bit n+1 for controlling visual attribute code propagation. In the disclosed embodiment of the invention, the video memory means comprises a screen memory of substantially 4096 bits deep by 8 bits wide and the attribute memory means is similarly of substantially 4096 bits deep by 8 bits wide. The attribute propagation memory means, on the other hand, is of smaller capacity substantially 4096 bits deep by 1 bit wide. With the attribute memory means being of 8 bit width it is essentially the 9 ninth attribute bit that functions as a control bit for attribute code propagation. Means are provided for writing into the attribute propagation memory means a control bit for controlling visual attribute code propagation. The system also includes a video display generator means controlled from at least the data words of the video memory means for controlling writing on the video display screen. Control means are provided intercoupled between the attribute memory means and video display generator means and responsive to the control bit for causing a predetermined attribute code to be propagated for a preselected number of screen character locations.

In accordance with one embodiment of the invention, the means for writing into the attribute propagation memory means may include a latch circuit that is under microprocessor control and adapted to write a "zero" into each address for which attribute propagation is to occur. The control means may comprise an attribute latch coupled from the visual attribute memory-to the video display generator means along with a control logic circuit that is responsive to the ninth bit or bit n+1 for controlling latching into the attribute latch. The control logic circuit includes logic gate means having an input controlled from the state of the binary ninth bit signal and also including an output coupled to the clock input of the attribute latch. A "zero" for the control bit inhibits further attribute data latching so as to propagate the previous attribute code. The propagation of the attribute code continues until a different attribute code occurs along with the control bit setting to a "one" binary state. In an alternate embodiment of the invention, the "one" and "zero" control previously described can be interchanged so that propagation occurs when the control bit gets set to a "one".

BRIEF DESCRIPTION OF THE DRAWINGS

Numerous other objects, features and advantages of the invention should now become apparent upon a reading of the following detailed description taken in conjunction with the accompanying drawings, in which:

FIG. 3 is a diagram illustrating sequences of attribute codes also indicating the ninth attribute bit for control.

DETAILED DESCRIPTION

In accordance with the present invention, there is described herein, an improved technique for handling visual attribute codes. In accordance with the system of the present invention, separate attribute codes may be assigned to each character that is to be displayed or in accordance with an alternate mode of operation in accordance with the invention, a particular attribute code may be propagated so that for a preselected number of screen character locations the same attribute code controls. This operation simulates an embedded attribute but carries this operation out without sacrificing a character position, or being restricted to a limited number of visual attribute changes that may occur.

Figure 1:
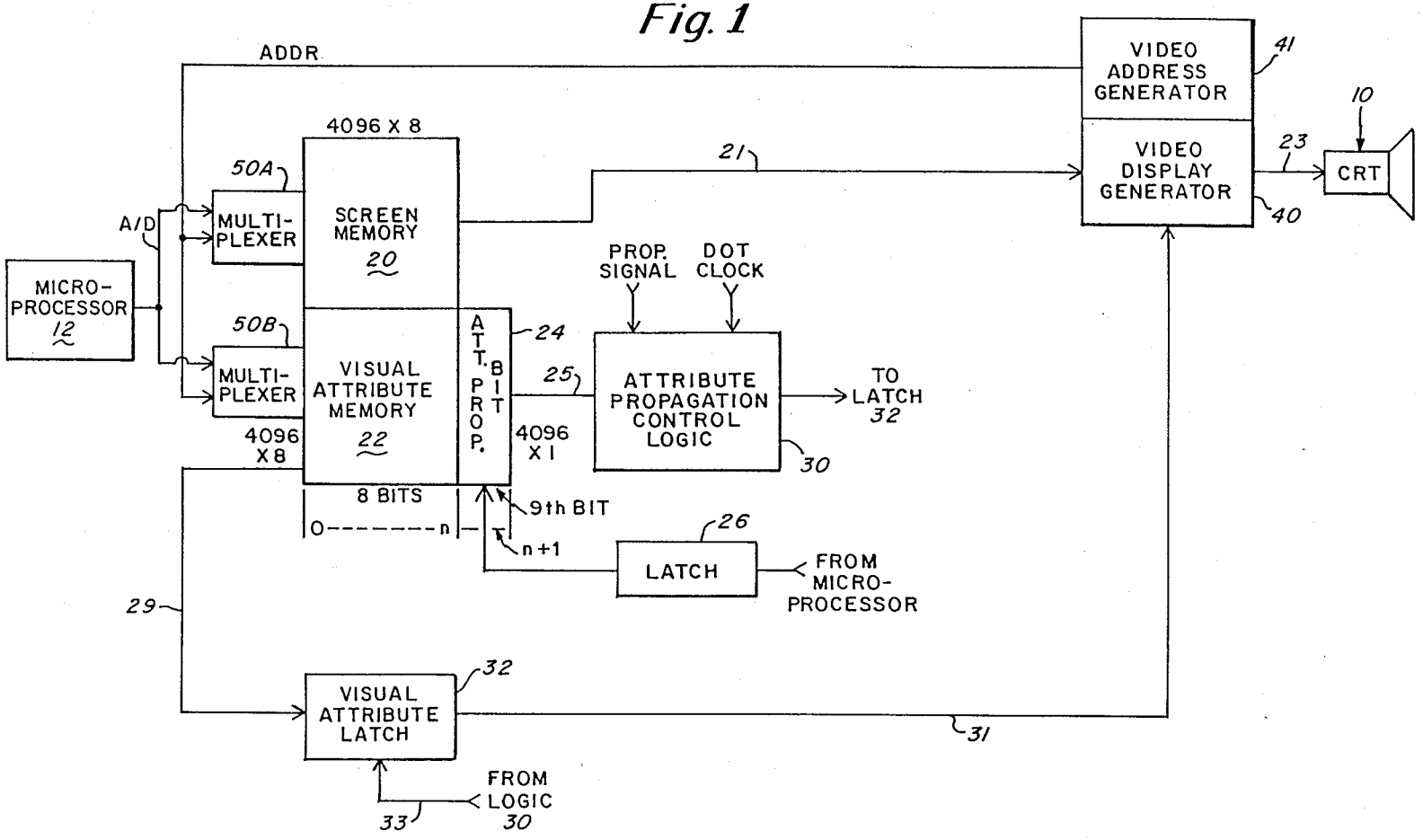
FIG. 1 is a block diagram of a system in accordance with the present invention for providing visual attribute code control.
Figure 2:
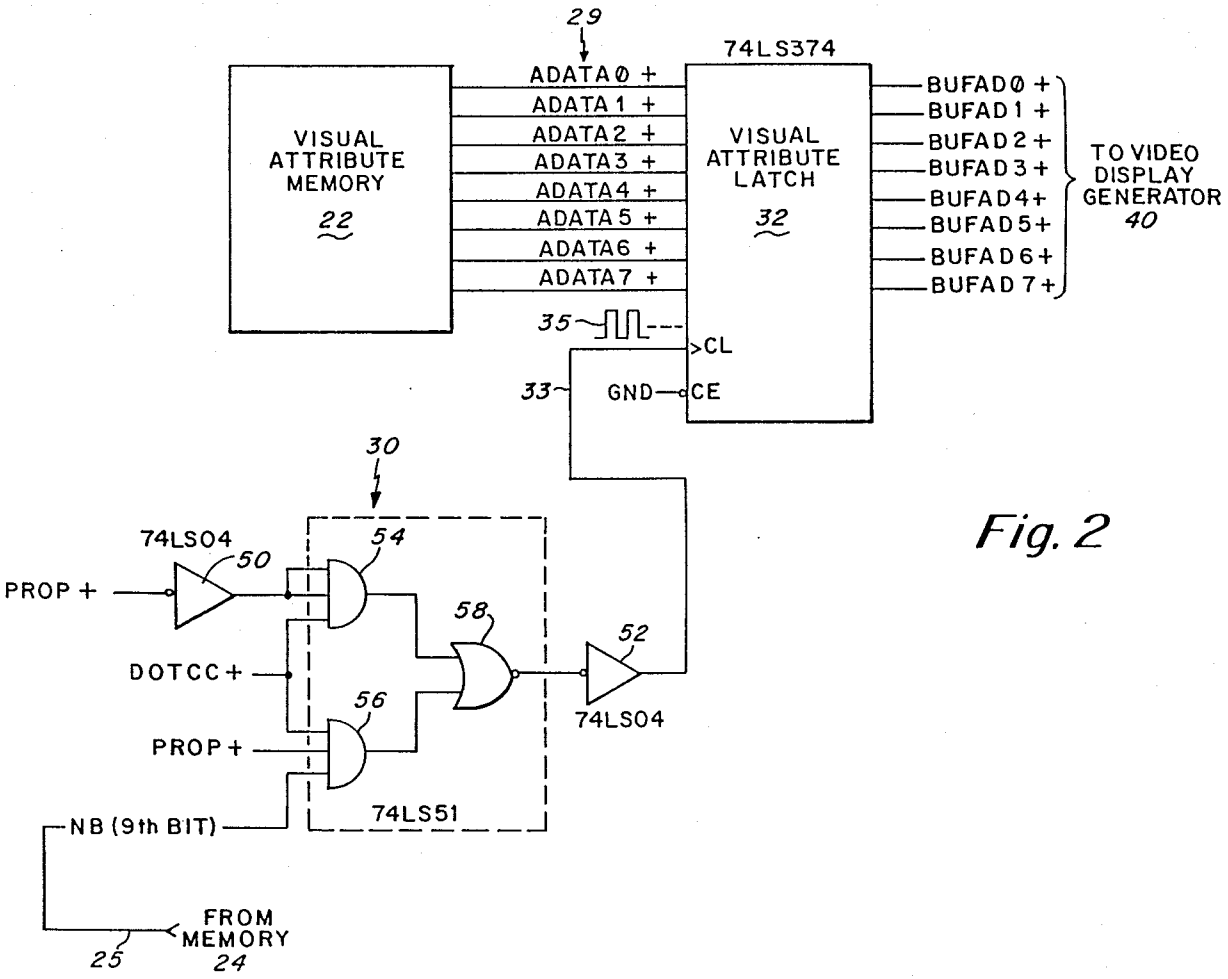
FIG. 2 is a block diagram showing further details in particular of the attribute propagation control logic of FIG. 1.

For a better understanding of a preferred embodiment of the present invention, reference is now made to FIG. 1 which is a system block diagram. FIG. 2 shows further details, in particular, of the attribute propagation control logic of FIG. 1.

With reference to FIGS. 1 and 2 there is shown a screen memory 20, which is of capacity 4096 bits deep by 8 bits wide. Similarly, associated with the memory 20 is a visual attribute memory 22 which is similarly of 4096 bits deep by 8 bits wide. The combination of these two memories provide 8 bits for a data word and an associated 8 attribute bits. A ninth attribute bit is added to the visual attribute bus wherein the first 8 bits are used for character generation control. The ninth bit, as illustrated in FIG. 1, is used for attribute propagation control. FIG. 1 illustrates this ninth bit in terms of an attribute propagation memory 24. This memory is in the form of a 4096 bit by 1 bit static RAM. Data fetched out of the address specified for visual attributes carries with it this bit from the 4K by 1 memory 24 because the same address is presented thereto. Common addresses are also presented to both the screen memory 20 and visual attribute memory 22. For the sake of simplicity in FIG. 1, address lines are not described, it being understood that addressing occurs such as from addresses generated at the video display generator for control in addressing all the memories 20, 22 and 24.

Now, with reference to FIG. 1, it is noted that, associated with the screen memory 20 and visual attribute memory 22, is the microprocessor 12. Data and address lines intercouple between the microprocessor 12 and these memories. Thus, by way of the microprocessor 12, data in the screen memory 20 and associated attribute data in the memory 22 may be altered under direct computer control. Similarly, there is provided a latch 26 controlled from the microcomputer 12. The latch 26 controls the writing into the attribute propagation memory 24 as will be described in further detail hereinafter in particular with reference to the diagram of FIG. 3.

FIG. 1 also shows the multiplexers 50A and 50B associated respectively with the screen memory 20 and visual attribute memory 22. These provide for multiplexing of the address signals. In one case the address signals may couple from the microprocessor 12 as illustrated. In another instance they are coupled from the video address generator 41.

In accordance with the computer system with which the video display screen is used, the system operates in a number of different modes including a 160 character per line mode referred to as a horizontal scroll mode as well as an 80 character per line mode which is a non-horizontal scroll mode. In this connection in my copending application Ser. No. 06/831,715 filed of even date herewith, there is described a system in which the ninth attribute bit is used, in the horizontal scroll mode of operation, for controlling horizontal scrolling. On the other hand, in accordance with the present invention, this ninth attribute bit stored in memory 24, when in the non-horizontal scroll mode, (80 characters per line mode) then the ninth attribute bit functions to control propagation of visual attributes thus simulating an embedded attribute system.

FIG. 1 also illustrates the video display generator 40 which intercouples data signals from the screen memory 20 to the CRT display 10 along with the video address generator 41. In this regard note the line 21 coupling from the memory 20 to the generator 40 and the line 23 coupling from the generator 40 to the CRT 10. Similarly, there is data output on line 29 from the visual attribute memory 22 to the visual attribute latch 32. The latch 32 receive in sequence visible attribute codes from the memory 22 and couples these codes to the video display generator 40 for control of the CRT 10. In this regard note the line 31 that couples from the visible attribute latch 32 to the video display generator 40. The video display generator 40 is considered as being of conventional design. For each character that is to be displayed, the code on line 21 is decoded to indicate the particular character or graphic display while the signal on line 31 that couples to the generator 40 indicates the particular attribute that is to be associated with the character. As indicated previously, typical visual attributes are blink, reverse video, and underline.

Also, there are a series of address signals that are conventionally generated such as by the video address generator 41. These provide addresses to the different memories that are described. In this regard, the memories 20, 22 and 24 are commonly addressed from the video address generator 41 when the video display generator 40 is ready to receive data regarding the next character that is to be displayed. The line 21 in FIG. 1 is representative simply of data flow from the screen memory 20 to the video display generator 40.

In FIG. 1, the attribute propagation memory 24 is indicated as having an output at line 25 that couples to the attribute propagation control logic 30. The output signal from the logic 30 couples to the input line 33 to the visual attribute latch 32. Control signals are also provided to the control logic 30 including a propagation signal and the dot clock signal as indicated in FIG. 1.

Reference is now made to FIG. 2 which shows further details of a part of the system of FIG. 1 and in particular further details of the attribute propagation control logic 30. FIG. 2 shows the visual attribute memory 22 having its 8 bit output on lines 29 and identified as data signals ADATA0–ADATA7. These signals couple to eight input terminals of the visual attribute latch 32 which is, of course, an 8 bit latch. When the latch 32 is clocked by a signal on line 33 from the attribute propagation control logic 30, then the last input data signal appears on the output as the respective signals BUFAD0–BUFAD7. This 8 bit signal couples to the video display generator 40.

The visual attribute latch 32 includes a clock input which, as mentioned previously, is coupled from the attribute propagation control logic 30. The latch 32 also has an enable input which is grounded as illustrated so that the latch 32 is always enabled. The attribute propagation control logic 30 includes a series of logic gates including inverters 50 and 52, AND gates 54 and 56, and NOR gate 58. The gates 54, 56 and 58 are formed by a standard logic circuit identified as circuit 74LS51. The inverters are circuit type 74LSO4.

As identified previously in FIG. 1, there is a propagation signal that is coupled to the control logic 30. This is identified in FIG. 2 as signal PROP+. The dot clock signal is also coupled to the control logic 30 and this appears as a signal DOT CC. There is also a signal NB which stands for ninth bit which is coupled to the AND gate 56 and which is generated from the attribute propagation memory 24. It is a "one" or "zero" state of the signal NB on line 25 from the memory 24 that determines whether visual attributes are to be selectively latched or whether a particular visual attribute is to be propagated. With the particular logic described in FIG. 2, a "zero" indicates attribute propagation.

In FIG. 2 if the propagation bit is set and thus the signal PROP is high and also if the signal NB on line 25 indicates that the ninth attribute bit is high or set, then gate 56 has a high output during the dot clock. Positive going pulses as indicated at 35 are coupled to the clock input of the visual attribute latch 32. The high output from the gate 56 is coupled at the output of the gate 58 as a low output which is in turn inverted by the gate 52 to a high pulse output as indicated in FIG. 2. This causes a clocking of the visual attribute latch 32 so that for a particular address that is being selected corresponding to a particular screen address location, the corresponding visual attribute code is entered into the latch 32. In other words a new attribute code is clocked into the attribute latch 32 and this is presented to the video display generator 40.

With reference to the operation of the attribute propagation control logic 30, reference is now also made to the diagram of FIG. 3 that illustrates in positions A, B, C, etc. a series of attribute codes each of 8 bits and also illustrating the ninth attribute bit as coupled from the memory 24. Thus, for example, in position A, in FIG. 3, it is noted that the ninth attribute bit is a "one" and as indicated previously this causes a clocking of the visual attribute latch 32 so that the associated attribute code is presented to the video display generator 40. In the example of position A in FIG. 3 this is the code 10000000.

Now, it is noted in FIG. 3 that the next visual attribute code in position B is a different code but still has the ninth attribute bit set. The same also applies to position C. Thus, for positions A, B and C in FIG. 3 the visual attribute latch 32 is successively clocked from the attribute propagation control logic 30. However, in position D in FIG. 3 it is noted that the ninth attribute bit is not set or in other words is a "zero". When this occurs, the output of the gate 56 is low and the output of gate 58 is high. The output of inverter 52 is low and thus the signal on line 33 to the clock input of the visual attribute latch 32 is a low signal not enabling any clocking of the visual attribute latch. Thus, in the instance of position D in FIG. 3 there is no clocking of the visual attribute and the current attribute is simply maintained in the latch. This is illustrated in FIG. 3 by a repeat of the attribute code which as noted appears both in positions C and D in FIG. 3. As long as the ninth attribute bit is reset as illustrated in FIG. 3, then regardless of the particular visual attribute code that is presented to the visual attribute latch, the latch always maintains the code that was initially set therein in position C of FIG. 3.

Thus, with the use of the ninth attribute bit, the initially set attribute code is simply propagated until a different attribute code is presented along with the setting of the ninth attribute bit. The setting of this bit is illustrated in position K in FIG. 3 in which the ninth attribute bit is a "one". When this occurs the clocking of the visual attribute latch 32 occurs again and at that time, the new attribute code is then latched into the visual attribute latch 32.

Having now described one preferred embodiment of the present invention, it should not be apparent to those skilled in the art that numerous other embodiments and modifications thereof are contemplated as falling within the scope of the present invention a defined by the appended claims. For example, a particular sequence of the ninth attribute bit has been illustrated in FIG. 3 but it is understood that a variety of different bit combinations can be employed to cause attribute code propagation in connection with a segment of a line, an entire line or a series of lines. Also, in the example given a binary "zero" indicates attribute bit propagation but it is understood that propagation could likewise be indicated by a binary "one".

What is claimed is:

1. In a computer system having a video display screen, apparatus for controlling visual attributes associated with characters displayed on the screen, said apparatus comprising:

processor means, video memory means for storing multiple data words corrsponding to screen character locations, attribute memory means associated with the video memory means for storing multiple visual attribute codes each of n attribute bits and corresponding to a data word and screen character location, means coupling said processor means to said video and attribute memory means for addressing thereof, attribute propagation memory means associated with said attribute memory means for storing at least bit n+1 for controlling visual attribute code propagation, latch means, means coupling said latch means from said processor means to said attribute propagation memory means for selectively writing into said attribute propagation memory means a control bit for controlling visual attribute code propagation, video display generator means controlled from at least said data words of the video memory means for controlling writing on the video display screen, and control means intercoupled between said attribute memory means and video display generator means and responsive to said control bit for causing a predetermined attribute code to be propagated for a preselected number of screen character locations.

2. Apparatus as set forth in claim 1 wherein said video memory means includes a screen memory of substantially 4096 bits deep by 8 bits wide, said 8 bits defining said data word and permitting the full 256 character codes.

3. Apparatus as set forth in claim 2 wherein said attribute memory means is of substantially 4096 bits deep by 8 bits wide.

4. Apparatus as set forth in claim 3 wherein said attribute propagation memory means is of substantially 4096 bits deep by 1 bit wide.

5. Apparatus as set forth in claim 1 wherein said video memory means and said attribute memory means are of substantially equal memory capacity.

6. Apparatus as set forth in claim 5 wherein said attribute propagation memory means is a smaller capacity than either of the video or attribute memory means.

7. Apparatus as set forth in claim 1 further including means for commonly addressing the video memory means, attribute memory means and attribute propagation memory means.

8. Apparatus as set forth in claim 1 wherein said means for writing into said attribute propagation memory means includes a latch circuit under microprocessor control writing a "zero" into each address for which attribute propagation is to occur.

9. Apparatus as set forth in claim 8 wherein said control means comprises an attribute latch coupled from the visual attribute memory to the video display generator means and a control logic circuit responsive to said bit n+1 for controlling latching into said attribute latch.

10. Apparatus as set forth in claim 9 wherein said attribute latch has a clock input and said control logic circuit includes logic gate means having an input controlled from the state of binary bit signal n+1 and an output coupled to the clock input of the attribute latch.

11. Apparatus as set forth in claim 10 wherein a "zero" for the control bit inhibits further attribute data latching so as to propagate the previous attribute code.

12. Apparatus as set forth in claim 11 wherein the propagation of the attribute code continues until a different attribute code occurs along with the control bit setting to a "one".

13. Apparatus as set forth in claim 12 wherein said logic gate means comprises at least an AND gate coupled to a NOR gate.

14. Apparatus as set forth in claim 1 wherein said latch means is controlled from said processor means to write predetermined bit information into said attribute propagation memory means independently of the control of the video and attribute memory means whereby visual attribute associated with a character are assignable on a character-by-character basis.

15. Apparatus as set forth in claim 14 wherein both the data word and attribute codes are of n bits.

16. In a computer system having a video display screen, apparatus for controlling visual attributes associated with characters displayed on the screen, said apparatus comprising;

video memory means for storing multiple data words corresponding to screen character locations, attribute memory means associated with the video memory means for storing multiple visual attribute codes each of n attribure bits and corresponding to a data word and screen character location, attribute propagation memory means associated with said attribure memory means for storing at least bit n+1 for controlling visual attribute code propagation, means coupled to said attribute propagation memory means for selectively writing into said attribute propagation memory means a control bit for controlling visual attribute code propagation, video display generator means controlled from at least said data words fo the video memory means for controlling writing on the video display screen, and control means intercoupled between said attribute memory means and video display generator means and responsive to said control bit for causing a predetermined attribute code to be propagated for a preselected number of screen character locations, said means for writing into said attribute propagation memory means comprising means to control writing of predetermined bit information into said attribute propagation memory means independently of the writing into said video and attribute memory means whereby visual attributes associated with a character are assignable on a character-by character basis.

17. Apparatus as set forth in claim 16 further including attribute propagation control logic means coupled intermediate said attribute propagation memory means and said control means and for reading said control bit to control said control means.

18. Apparatus as set forth in claim 17 wherein said attribute propagation control logic means comprises a control logic circuit, means for receiving said control bit and means for establishing a propagation mode signal having a propagation state in which said control logic circuit is responsive to said control bit to control said control means as a function of the state of the control bit, and a non-propagation state in which said control means is controlled to select a new attribute code irrespective of the state of said control bit.

19. Apparatus as set forth in claim 17 wherein said control means comprises an attribute latch having a clock input and said control bit has respective propagation and latch states.

20. Apparatus as set forth in claim 19 wherein said control logic circuit includes gate means for receiving said contorl bit, propagation mode signal and a clock signal and having an output coupled to the clock input of the attribute latch.

21. Apparatus as set forth in claim 20 wherein said gate means clocks said attribute latch with a new attribute code when in the propagation mode and when the control bit is in its latch state.

22. Apparatus as set forth in claim 21 wherein said gate means is inhibited from clocking said attribute latch to enable attribute code propagation when in the propagated mode and when the control bit is in its propagation state.

23. Apparatus as set forth in claim 22 wherein said gate means comprises a pair of AND gate means coupled to an OR gate means with the AND gate means receiving the respective propagation mode signal and control bit signal.

24. Apparatus as set forth in claim 16 wherein said control bit is used to identify one of attribute control and horizontal scroll control.

* * * * *